US005553512A

United States Patent [19]

Harimoto

[11] Patent Number: 5,553,512

[45] Date of Patent: Sep. 10, 1996

[54] ROLLER TAPPET HAVING YOKE MEMBER WITH FLAT TOP PLATE

[75] Inventor: Kazuyoshi Harimoto, Iwata, Japan

[73] Assignee: NTN Corporation, Osaka, Japan

[21] Appl. No.: 120,419

[22] Filed: Sep. 14, 1993

[51] Int. Cl.[6] ..... F01L 1/14

[52] U.S. Cl. ..... 74/569; 123/90.55

[58] Field of Search ..... 74/569; 123/90.55

[56] References Cited

U.S. PATENT DOCUMENTS

| | | | |
|---|---|---|---|
| 1,869,383 | 8/1932 | Mackenzie | 123/90.55 |
| 2,931,347 | 4/1960 | Williams | 123/90.55 X |
| 4,231,267 | 11/1980 | Van Slooten | 74/569 |
| 4,885,952 | 12/1989 | Connell | 74/569 |
| 5,168,841 | 12/1992 | Suzuki et al. | 74/569 X |
| 5,307,769 | 5/1994 | Meagher et al. | 74/569 X |

FOREIGN PATENT DOCUMENTS

| | | | |
|---|---|---|---|
| 4287807 | 10/1992 | Japan | 74/569 |

*Primary Examiner*—Rodney H. Bonck
*Assistant Examiner*—Mary Ann Battista
*Attorney, Agent, or Firm*—Nikaido, Marmelstein, Murray & Oram LLP

[57] ABSTRACT

Roller tappet can be manufactured with less machining steps to reduce the manufacturing cost. The tappet case consists of two members, i.e. case member and yoke member for supporting a roller. These members are coupled together by fixing the top end of the yoke member to the bottom of the case member.

7 Claims, 2 Drawing Sheets

ROLLER TAPPET HAVING YOKE MEMBER WITH FLAT TOP PLATE

This invention relates to a roller tappet used to open and close an overhead valve of an automotive engine or the like.

As a means to improve the fuel efficiency of automobiles, roller type tappets are widely used for driving mechanisms for overhead valves.

Conventional roller tappets comprise, as shown in FIG. 5, a tappet case 1 and a roller 2. In the top end of the tappet case 1 is formed a hole 3 for receiving a tappet rod. In the lower end of the tappet case 1 is formed a roller mounting groove 4. The roller 2 is mounted in the groove 4 and rotatably supported on a shaft 5 fixed to walls at both sides of the groove 4.

Such a tappet case 1 is formed by lathing, milling and grinding a cold-forged material. Thus, its manufacturing process involves many machining steps and its cost is high.

It is therefore an object of the present invention to reduce the manufacturing cost of a roller tappet by reducing the number of machining steps required.

According to the present invention, there is provided a roller tappet comprising a tappet case for receiving and supporting the bottom end of a push rod, and a roller mounted on the bottom end of the tappet case, the tappet case comprising a cup-shaped case member and a yoke member for supporting the roller, at least one of the case member and the yoke member being formed by drawing a metal plate, the case member and the yoke member being coupled together by fixing the top end of the yoke member to the bottom surface of the case member.

The roller of the roller tappet is brought into contact with a cam, while a push rod is inserted in the top opening in the case member. Thus, the rotary motion of the cam is transmitted to a rocker arm through the push rod.

The tappet case according to this invention comprises two members, i.e. case member and yoke member. Both of the members can be easily formed by drawing. This makes it possible to reduce the number of machining steps. Thus, the roller tappet can be manufactured at low cost.

Other features and objects of the present invention will become apparent from the following description made with reference to the accompanying drawings, in which.

Figure 1:
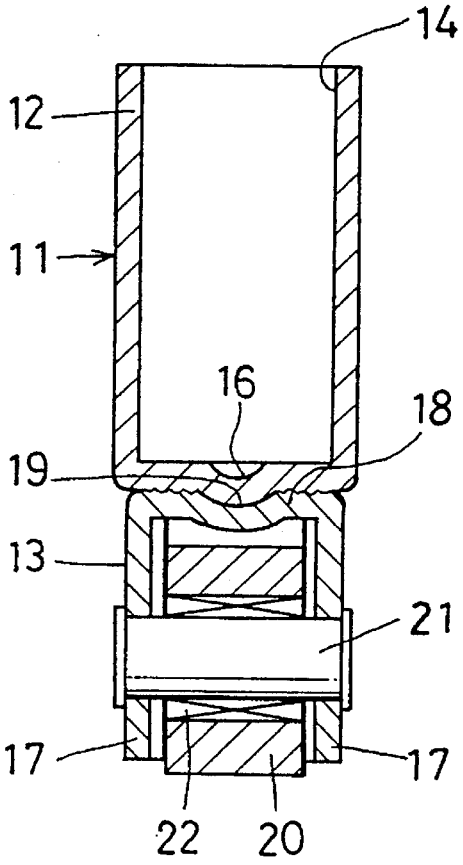
FIG. 1 is a sectional view of the first embodiment.
Figure 2:
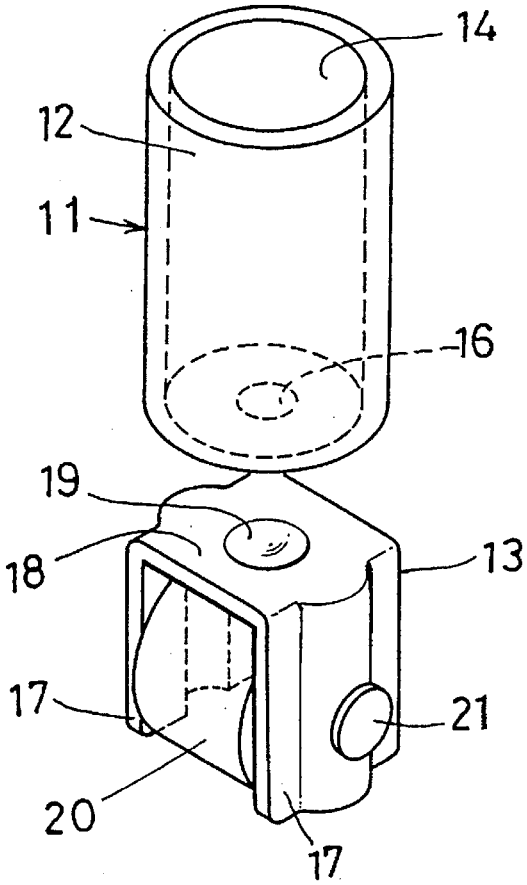
FIG. 2 is an exploded perspective view of the same.

The roller tappet of the first embodiment shown in FIGS. 1 and 2 has a tappet case 11 which consists of two members, i.e. a cup-shaped case member 12 and a yoke member 13. The case member 12 is formed by drawing a metal plate into a cup shape having an opening 14 at its top. In the bottom of the case member 12 is formed a recess 16 to receive the bottom end of a push rod.

The yoke member 13 is gate-shaped comprising side walls 17 and a top wall 18 extending between the top ends of the side walls 17. It is also formed by drawing a metal plate. The top wall 18 of the yoke member 13 has in its top surface a shallow recess 19 complementary in shape to a protrusion formed on the bottom of the case member 12 when forming the recess 16. Each side wall 17 has its central part arcuately raised (FIG. 2) to strengthen the entire member 13. A roller 20 is inserted between the side walls 17 and rotatably mounted through a bearing 22 on a shaft 21 extending through and secured to the side walls 17.

The case member 12 and the yoke member 13 are secured together by spot-welding the bottom of the case member 12 to the top wall 18 of the yoke member 13.

Either the case member 12 or the yoke member 13 may be formed by shaving or die-casting.

Figure 3:
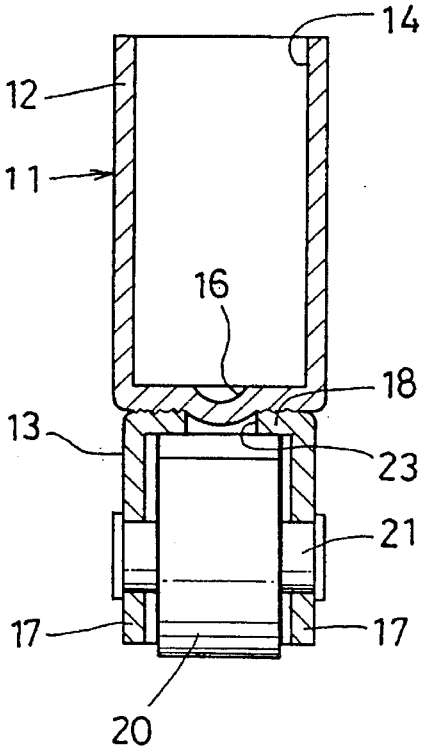
FIG. 3 is a sectional view of the second embodiment.

In the second embodiment shown in FIG. 3, an opening 23 is formed in the top wall 18 of the yoke member 13 in which is received the protrusion formed on the bottom of the case member 12. The opening 23 is more advantageous than the recess 19 shown in FIG. 1 in that the case member 12 can be easily positioned on the top surface of the yoke member 13. Otherwise, this embodiment is the same as the first embodiment.

Figure 4:
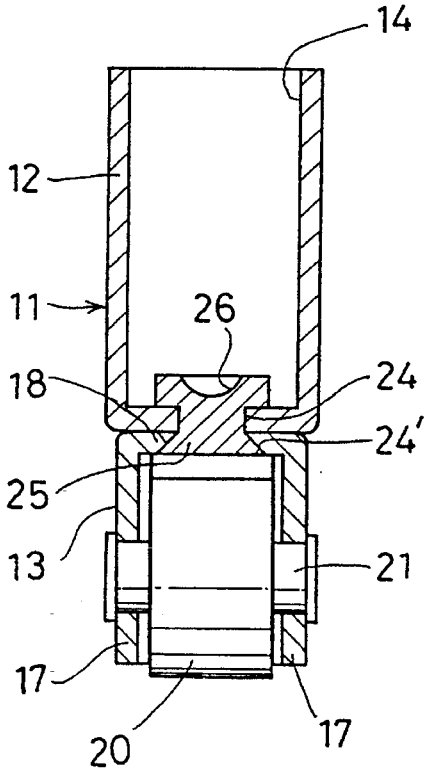
FIG. 4 is a sectional view of the third embodiment.
Figure 5:
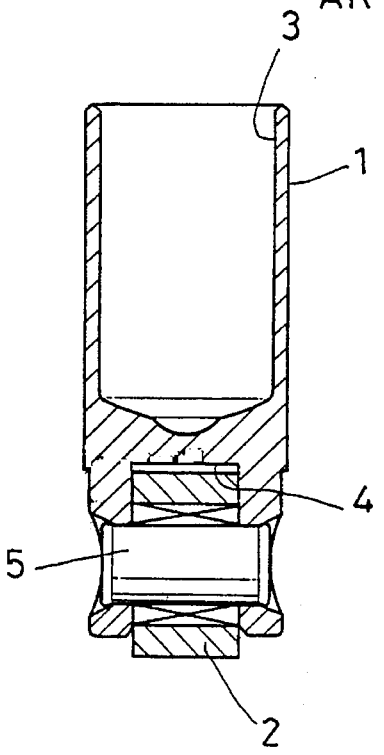
FIG. 5 PRIOR ART
FIG. 5 is a sectional view of a conventional roller tappet.

In the third embodiment shown in FIG. 4, rivet holes 24, 24' are formed in the bottom surface of the case member 12 and the top wall 18 of the yoke member 13, respectively. A rivet 25 is inserted through the rivet holes 24, 24' and caulked to couple the case member 12 to the yoke member 13. In this case, a recess 26 is formed in the top surface of the rivet 25 to support the bottom end of the push rod. Otherwise, this embodiment is the same in structure as the first embodiment.

In any of the above embodiments, the push rod is inserted in the opening 14 in the case member 12 and its lower end is received in the recess 16 or 26. The roller 20 is brought into contact with a cam. As the cam rotates in this state, its movement is transmitted to a rocker arm through the push rod.

In operation, the tappet case 11 is subjected to only compressive loads. Thus, the use of a tappet case comprising two separate members will raise no functional problem.

What is claimed is:

1. A roller tappet comprising a cup-shaped, closed bottom case member for receiving and supporting the bottom end of a push rod; a yoke member comprising a top plate immorably coupled to a bottom surface of said case member and side walls extending from said top plate in a direction away from said case member; and a roller mounted in said yoke member and having a shaft supported on said side walls of said yoke member.

2. A roller tappet as claimed in claim 1, wherein said case member and said yoke member are made of different materials.

3. A roller tappet as claimed in claim 1, wherein said bottom surface of said case member has a protrusion extending therefrom and said top plate has a opening therein complementary to said protrusion, said case member and said yoke member being coupled by spot welding said bottom surface to said top plate with said protrusion in said opening.

4. A roller tappet as claimed in claim 1, wherein said bottom surface of said case member and said top plate have axially aligned rivet holes therein and said tappet further comprises a caulked rivet in said rivet holes coupling said case member to said yoke member.

5. A roller tappet as claimed in claim 1, wherein each said side wall of said yoke member has an arcuately raised central part strengthening said yoke member.

6. A roller tappet as claimed in claim 1, wherein said bottom surface of said case member has a protrusion extending therefrom and said top plate has a recess therein complementary to said protrusion, said case member and said yoke member being coupled by spot welding said bottom surface to said top plate with said protrusion in said recess.

7. A roller tappet as claimed in claim 6, wherein an inner surface of said closed bottom case member has a centered recess to receive the bottom end of the push rod, said protrusion on said bottom surface being formed when said centered recess is formed.

* * * * *